US008956270B2

(12) United States Patent
Bell et al.

(10) Patent No.: US 8,956,270 B2
(45) Date of Patent: Feb. 17, 2015

(54) ROWING SEQUENCE TRAINER

(71) Applicants: Edward J. Bell, Medford, NJ (US); Gerard A. Raus, Lansdale, PA (US)

(72) Inventors: Edward J. Bell, Medford, NJ (US); Gerard A. Raus, Lansdale, PA (US)

( * ) Notice: Subject to any disclaimer, the term of this patent is extended or adjusted under 35 U.S.C. 154(b) by 126 days.

(21) Appl. No.: 13/707,709

(22) Filed: Dec. 7, 2012

(65) Prior Publication Data

US 2013/0150216 A1 Jun. 13, 2013

Related U.S. Application Data

(60) Provisional application No. 61/568,708, filed on Dec. 9, 2011.

(51) Int. Cl.

| | |
|---|---|
| ***A63B 69/06*** | (2006.01) |
| ***A63B 71/00*** | (2006.01) |
| ***A63B 22/00*** | (2006.01) |
| ***A63B 21/00*** | (2006.01) |
| ***A63B 23/02*** | (2006.01) |
| ***A63B 23/035*** | (2006.01) |
| ***A63B 24/00*** | (2006.01) |

(52) U.S. Cl.

CPC ..... *A63B 22/0076* (2013.01); *A63B 21/1411* (2013.01); *A63B 21/1415* (2013.01); *A63B 23/0222* (2013.01); *A63B 23/03583* (2013.01); *A63B 24/0087* (2013.01); *A63B 2022/0079* (2013.01); *A63B 2225/093* (2013.01)

USPC ..... 482/139; 482/72

(58) Field of Classification Search

USPC ..... 482/72, 51, 23, 70, 71, 92–96, 482/133–137, 139, 141, 142

See application file for complete search history.

(56) References Cited

U.S. PATENT DOCUMENTS

| | | | | |
|---|---|---|---|---|
| 3,904,196 | A * | 9/1975 | Berlin | 482/72 |
| 8,057,371 | B2 * | 11/2011 | McBride et al. | 482/142 |
| 2002/0065174 | A1 * | 5/2002 | Chen | 482/72 |
| 2006/0183606 | A1 * | 8/2006 | Parmater | 482/72 |
| 2007/0293376 | A1 * | 12/2007 | Tsai | 482/72 |
| 2008/0242519 | A1 * | 10/2008 | Parmater | 482/72 |

* cited by examiner

*Primary Examiner* — Oren Ginsberg
*Assistant Examiner* — Megan Anderson
(74) *Attorney, Agent, or Firm* — William H. Eilberg

(57) ABSTRACT

A rowing sequence trainer includes a frame which holds a contact pad, the frame being mounted pivotably to a base. The base is inserted under a seat of an exercise machine, the seat being slidable along a support. The exercise machine includes at least one resilient cable which is attached to the frame. The athlete using the trainer pushes back along the support, while the frame pivots backwards. At the completion of the backward segment, tension in the cable pulls the athlete back to the starting position, and pivots the frame to its upright position. The exercise is performed without the assistance of hands, and trains the athlete in the proper sequence of initiation of tension in various muscle groups.

16 Claims, 5 Drawing Sheets

ROWING SEQUENCE TRAINER

CROSS-REFERENCE TO PRIOR APPLICATION

Priority is claimed from U.S. provisional patent application Ser. No. 61/568,708, filed Dec. 9, 2011, the disclosure of which is hereby incorporated by reference herein.

BACKGROUND OF THE INVENTION

The present invention is a training device and method, for use in teaching an athlete to use the proper and desired motions in performing an exercise, such as rowing. In particular, the device and method of the present invention teach the athlete to perform complex motions in the most efficient manner.

In rowing, an athlete performs work on oars across several muscle groups. For ease of explanation, these muscle groups can be categorized in three groups, namely legs, back, and arms. A rower's performance can be limited by the sequence of muscle group initiation.

The handle of the oar, at the beginning of a rowing stroke, is moving at its lowest speed relative to the boat. Then, during the stroke, the oar handle is accelerated through the end of the stroke. If the athlete pulls with the arms prematurely, prior to initiating effort with the legs, the athlete's arms will tire, and this could lead the athlete to believe that his or her arms are being effectively exercised because the load feels high. In effect, the work done on the oar is substantially less than if the arms start to pull on the oars later in the drive sequence.

It is therefore an object of the present invention to teach the athlete to avoid using the arms at all, at the beginning of the stroke.

The same holds true for the use of the back muscles, prior to the time that the legs have brought the handle to a velocity such that the back can effectively contribute acceleration. In other words, one does not want the back to be doing work at the beginning of the rowing stroke.

The present invention teaches the athlete not to initiate the use of the arms or back too early in the exercise cycle. The device of the present invention makes it difficult for the athlete to do the exercise incorrectly, and thereby trains the athlete to perform the exercise in the most efficient manner.

Complex motions are those motions that use several muscle groups or joints. A common complex training lift is a power clean. A power clean is a lift where an athlete starts in a standing position and lifts a barbell from the floor to his or her chin level. This motion requires both strength and proper technique across the involved muscle groups. Common technical errors will limit the athlete's performance. These technical errors involve the initiation of a smaller muscle group prior to the mass of the barbell reaching a velocity that can be accelerated by the joining muscle group.

For the example of the power clean, the correct technique involves initiating the stroke by pushing with the legs until the mass is moving upward fast enough where the back can contribute to the acceleration. The back and legs at this point are working simultaneously until the mass is moving fast enough where the arms can contribute to the upward velocity. At this point the legs, back, and arms are accelerating the mass upward. If the smaller muscle groups are initiated prior to the mass moving upward fast enough, the smaller muscles will fail to accelerate the mass and the athlete will be limited in the mass used, not due to strength but due to technique.

For either the power clean or the rowing motion, the larger muscle groups supply the greatest amount of energy and are used during the slowest portions but are used throughout the entire motions. The back contributes a lesser amount of energy than the legs but the speed contributions are substantially higher. The arms contribute less energy than the legs or back but are responsible for even higher speed. This motion is analogous to a whip motion and can be quickly identified in nearly every athletic motion.

The present invention is, in effect, an exercise device in which the athlete does not use his or her arms. The invention therefore isolates the effect of the largest energy contributors, namely the legs and then the back, on the exercise motion. By eliminating the arms from the motion and increasing the moment arm that defines the loading of the back, the result of incorrect motion is magnified. When this mechanism is used by attaching it to a prior art rowing machine, or to an exercise machine such as that described in pending U.S. patent application Ser. No. 12/907,807, the disclosure of which is incorporated by reference herein, the athlete quickly learns the relationship between force, speed, and muscle group sequencing.

SUMMARY OF THE INVENTION

The present invention comprises a device, intended to be attached to an exercise machine, such as a rowing machine or weight-lifting machine, which enables an athlete to perform an exercise without the use of arms, and which thereby trains the athlete in the proper use of leg and back muscles. The invention also includes a method of athletic training.

The device of the present invention includes a frame and a base, the base being adapted to be inserted between a seat and a rail or support of an exercise machine. The frame is pivotable with respect to the base. The frame supports a contact pad, which preferably has the form of a cylinder, the contact pad being positioned to touch the back of the athlete. Attached to the contact pad is a pair of grips, which the athlete can grasp with his or her hands during the exercise. The frame provides tie points for a pair of resilient cables, the cables being connectable to another cable provided with the exercise machine. In a preferred embodiment, it is possible to adjust the vertical position of the contact pad, and the position at which the cables are connected, along the frame.

In operation, the athlete attaches the base between the seat and the rail or support of the exercise machine. The athlete then sits on the seat, grasps the grips provided with the device, and performs a rowing operation, all without using his or her arms as a means of propulsion. During the exercise cycle, the frame pivots as the athlete progresses through the various segments of the exercise. By grasping the grips, the athlete holds the contact pad against his or her back at all times during the cycle. The athlete otherwise does no work by means of the grips; substantially all of the athlete's motion is caused by exercise of leg and back muscles. The exercise teaches the athlete the proper use of the leg and back muscles, and enables the athlete to perform more effectively when exercising in a conventional manner.

DETAILED DESCRIPTION OF THE INVENTION

Figure 1:
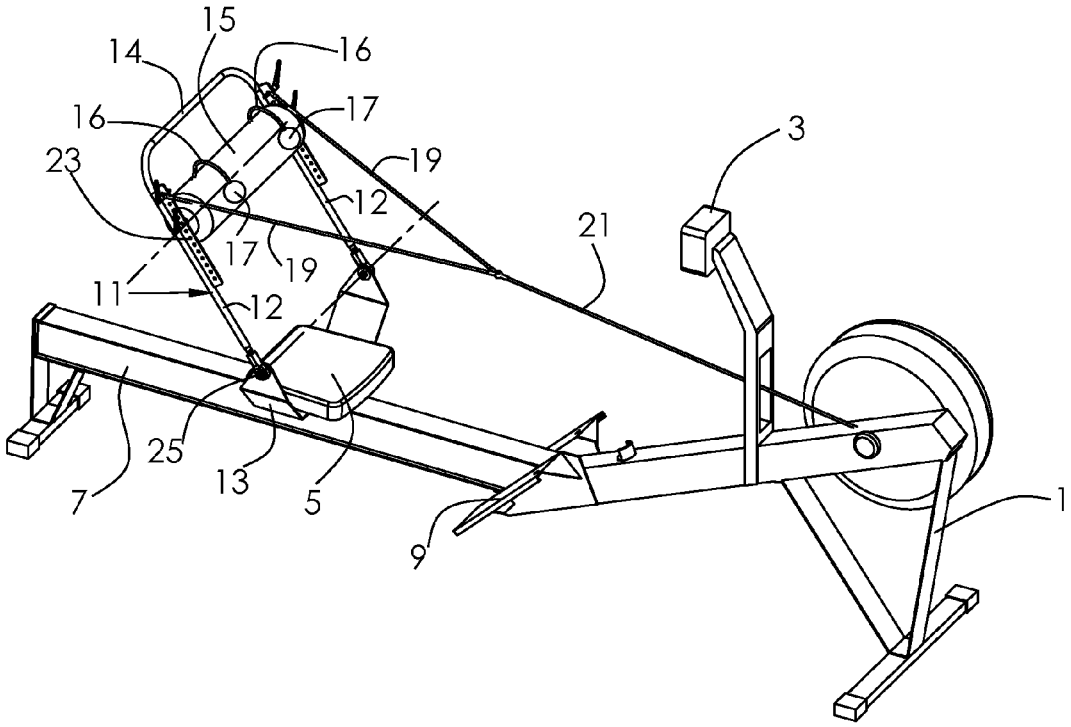
FIG. 1 provides a perspective view showing the device of the present invention connected to a rowing machine.

FIG. 1 shows the device of the present invention, as used with a conventional rowing machine 1. The rowing machine 1 shown in the figure is only illustrative; it is an important feature of the present invention that the inventive device can be used with a very wide variety of rowing machines.

The rowing machine 1 shown in FIG. 1 includes a monitor 3 for enabling the user to monitor his or her progress, and it includes a seat 5 which slides back and forth along a rail 7 or other support, and a pair of foot stretchers or foot rests 9. All of the above-described features are part of the prior art rowing machine 1, and are not part of the present invention. Thus, the device of the present invention could be used, for example, with a rowing machine that does not have a monitor, or with some other exercise machine that is not a rowing machine.

The device of the present invention includes a frame 11 which is pivotably mounted to a base 13. The frame 11 includes substantially parallel bars 12 having first and second ends. The first ends of the parallel bars 12 are connected to each other by cross bar 14. The second ends, i.e. the lower ends in FIG. 1, are pivotably connected to a base 13.

Figure 8:
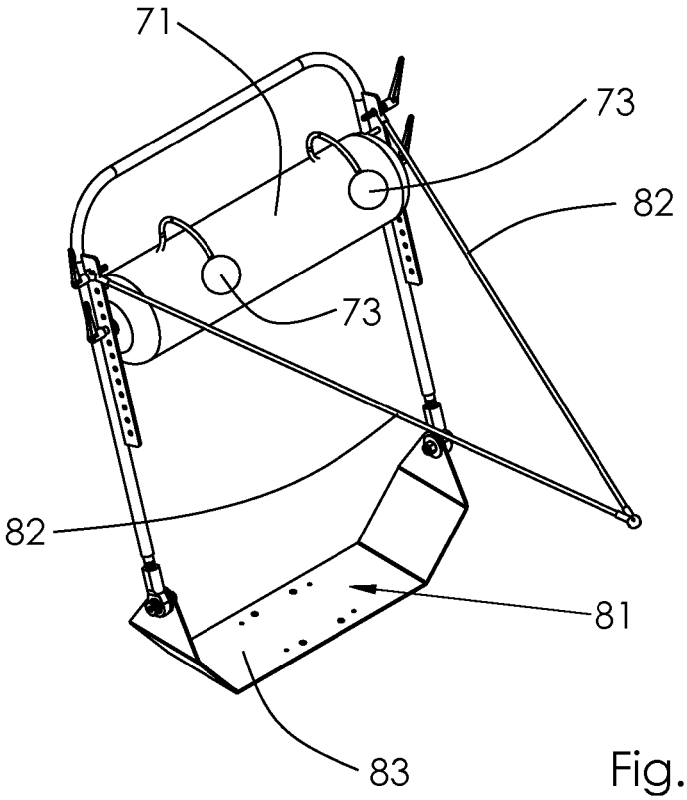
FIG. 8 provides a perspective view of the device of the present invention, wherein the device is shown in isolation, and without attachment to an exercise machine.
Figure 9:
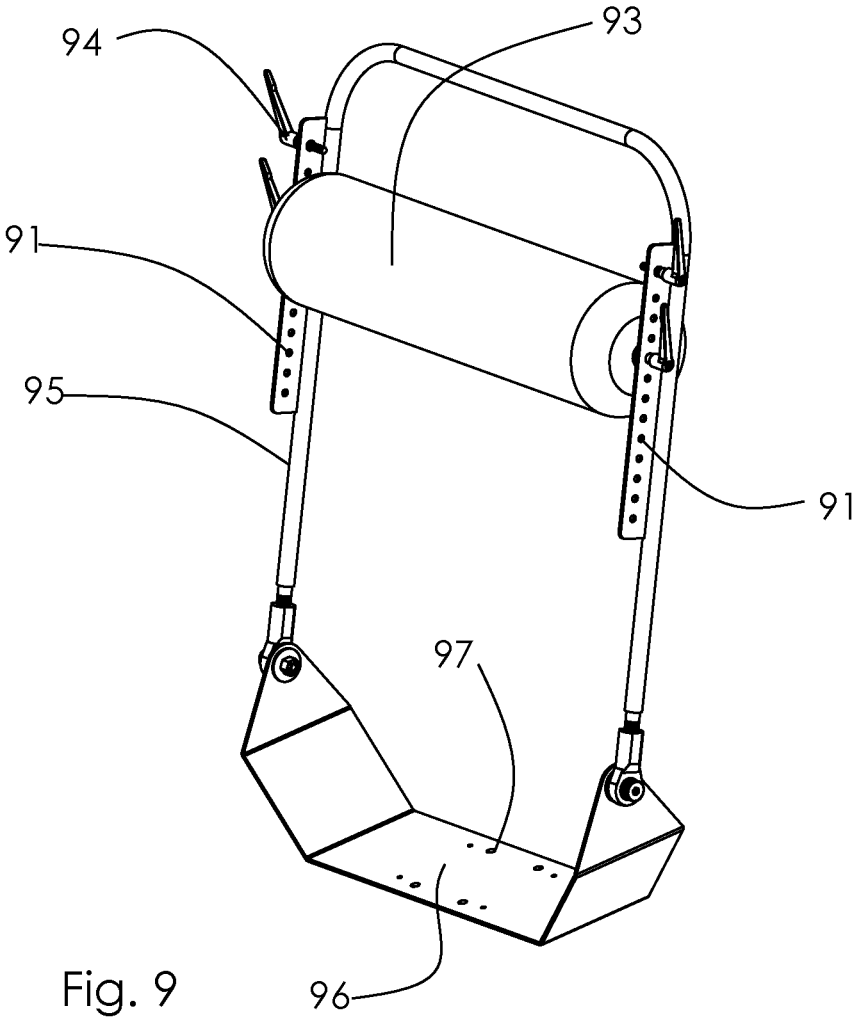
FIG. 9 provides another perspective view of the device of the present invention, showing the device in isolation.

The base 13, shown in FIG. 1 and more fully in FIGS. 8 and 9, comprises a plurality of articulated, flattened members, which connect to both of the second ends of the parallel bars defining the frame. The base is intended to be inserted between the seat 5 of the rowing machine, and the rail 7 or other support upon which the seat slides. Thus, the central member of the base, which is not fully visible in FIG. 1 but which is illustrated more clearly in FIG. 8 (see reference numeral 83) and FIG. 9 (see reference numeral 96), has an area which is a substantial fraction, such as about one-half, or more, of the area of the seat. This flat structure enables the base to be held securely under the seat.

The frame 11 also supports a contact pad 15, which preferably has the form of a cylinder, and which is positioned so as to contact the back of the athlete. Attached to the contact pad 15 are a pair of grips 17, which the athlete can grasp.

The position of the contact pad 15 is adjustable, such that the contact pad can be moved up or down along the frame. In particular, the contact pad is mounted to perforated adjustment strips 23, which strips can accommodate the contact pad at different vertical positions. This adjustment allows the same device to accommodate different athletes having differing heights. There is a natural spot at which a given athlete will prefer the contact pad to be, similar to what is felt with the back of a chair. It would be awkward for the contact pad to be too low. In general, the adjustment of the contact pad normally needs to be made only once for an individual user.

The adjustment strips 23 also comprise structures to which resilient cables 19 are attached. The cables 19 are attached to selectable locations along the strips by means of a fastener such as a bolt, or wingnut, or the like. The cables 19 are in turn connected to each other, and then connected to another cable 21, of similar resilience to cables 19, the cable 21 being attached to the rowing machine or other exercise machine. The moment arm of the force exerted on the frame by cables 19 can be adjusted by attaching the cables at varying positions along the adjustment strips 23. Adjustments upward, or away from the pivot point 25, magnify the difficulty imparted on the user, when the user initiates early use of back muscles.

The grips 17 comprise objects which can be grasped by the hands of the athlete when the device is in use. But the grips are not connected to the cables, or to any part of the exercise machine, and are not directly involved in the performance of any-physical work during the exercise. The grips simply provide a place for the athlete to place his or her hands, and also allow the athlete to insure that the contact pad 15 remains in contact with the athlete's back during the entire exercise cycle. The grips are therefore substantially independent of the cables. The grips are fastened to the contact pad by elastic bands 16. The grips could alternatively be fastened directly to the frame.

In one embodiment, the athlete may cross his or her arms across the chest, and engage the grips in this manner. The athlete could instead engage the grips without crossing the arms.

In preparing the device of the present invention for use, the athlete mounts the base 13 to the seat 5 of the rowing machine. This task is done by removing the screws (not shown) that connect the seat to the rail, carriage, or other support 7 provided by the rowing machine or exercise machine. Thus, the base 13 of the present invention is positioned between the seat 5 and the rail or other support 7, the seat being re-installed over the base. Screw holes in the base (shown in FIGS. 8 and 9) allow the base to be screwed onto the support or rail, preferably by the same screws which attach the seat. The cable 21 is then connected to the rowing machine or exercise machine.

When the device of the present invention has been installed on the rowing or exercise machine 1, the base 13 is slidably connected to the machine, and the cables 19 are connected to cable 21, which can connect, in place of the machine handle, to a handle (not shown) or other component of the exercise machine. The athlete sits on the seat 5, with the contact pad 15 touching the athlete's back. The grips 17 are held by the athlete's hands, and the athlete uses the foot stretchers 9 of the exercise machine to push away from the machine.

For each segment, the athlete pushes on the foot stretchers 9, thereby causing the seat 5 to translate. Work is applied to the rowing or exercise machine through the cables. The athlete translates his or her back and upper body until the seat is moving fast enough to begin back extension effectively.

If the point of connection of the cables 19 to the adjustment strips 23 is moved farther away from the pivot points 25, i.e. upward along the frame 11, the athlete is required to achieve higher speed with the seat prior to initiating back extension. The athlete is quickly taught the proper motion of rowing by the feedback of the rowing machine monitor system 3 or the movement of weights (not shown) on the exercise machine, or by other means.

Figure 2:
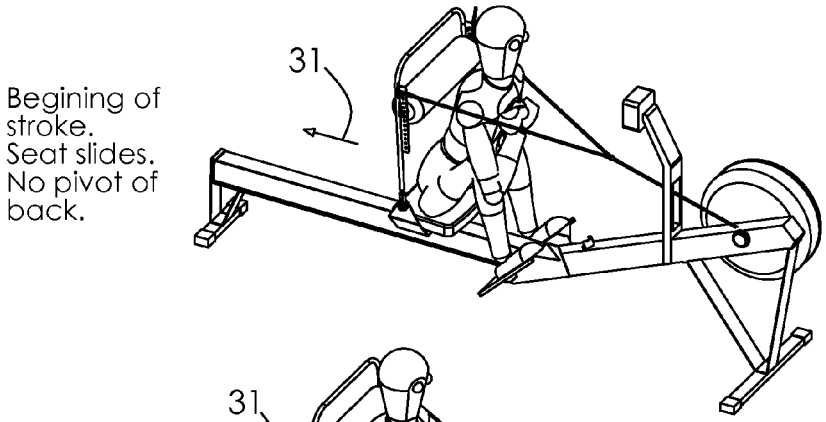
FIGS. 2-5 provide diagrams illustrating the use of the device of the present invention, through the four segments of a rowing exercise cycle.

FIGS. 2-5 illustrate the four segments of the exercise cycle, when the device of the present invention is used. FIG. 2 shows the first segment, wherein the athlete pushes with his feet and the seat starts to slide back, as indicated by arrow 31. At this point, the athlete's back has not yet started to pivot.

Figure 3:
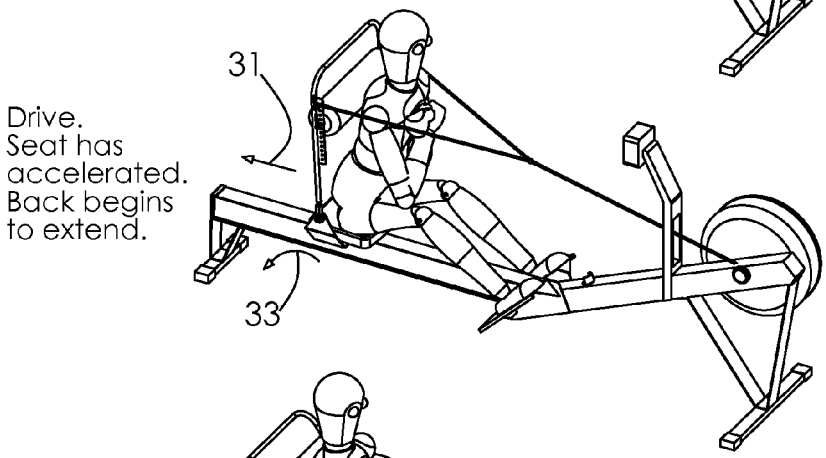

FIG. 3 shows the drive segment, wherein the seat has reached its maximum speed, and wherein the back of the athlete begins to extend. The pivoting of the frame, which has just begun in FIG. 3, is indicated by arrow 33.

Figure 4:
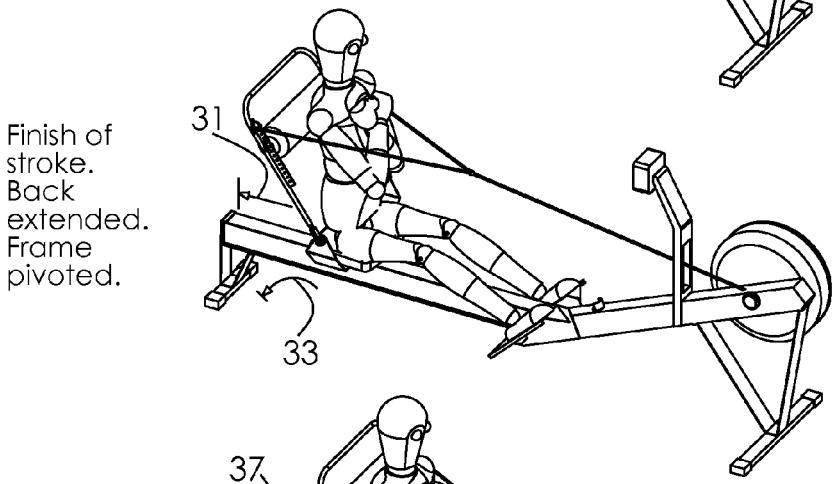

FIG. 4 shows the athlete at the end of the exercise segment, wherein the legs of the athlete are fully extended, and wherein the back is also extended, with the frame pivoted. Arrows 31 and 33 indicate that the translation of the seat and the pivoting of the back are completed at about the same time.

Figure 5:
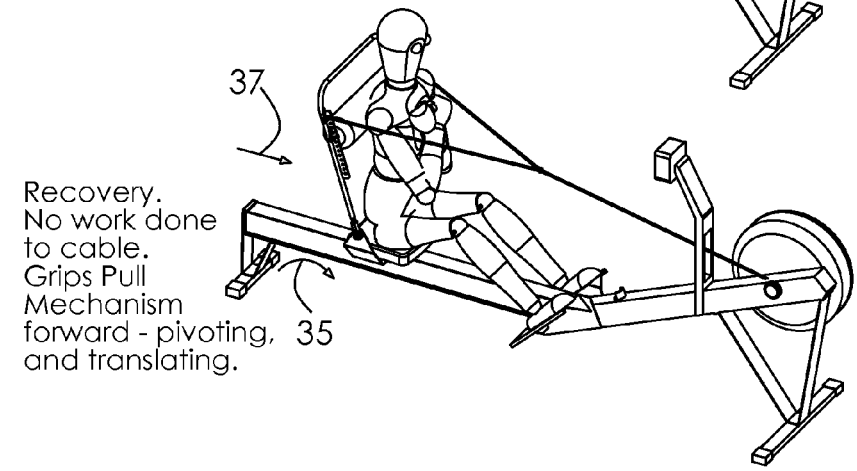

FIG. 5 shows the recovery segment. During this segment, no work is done by the athlete with respect to the cable. The forward motion of the athlete is due primarily to the elasticity of the cable; the cable, having been stretched, now returns to its original condition, bringing the athlete forward. During this time, the athlete maintains his or her hold on the grips, thereby holding the contact pad against the back. The grips do not play a role in bringing the seat forward, but simply prevent the frame from tilting back. The frame therefore pivots forward to its original position, as indicated by arrow 35, while the device translates to the right, as shown by arrow 37.

Figure 6:
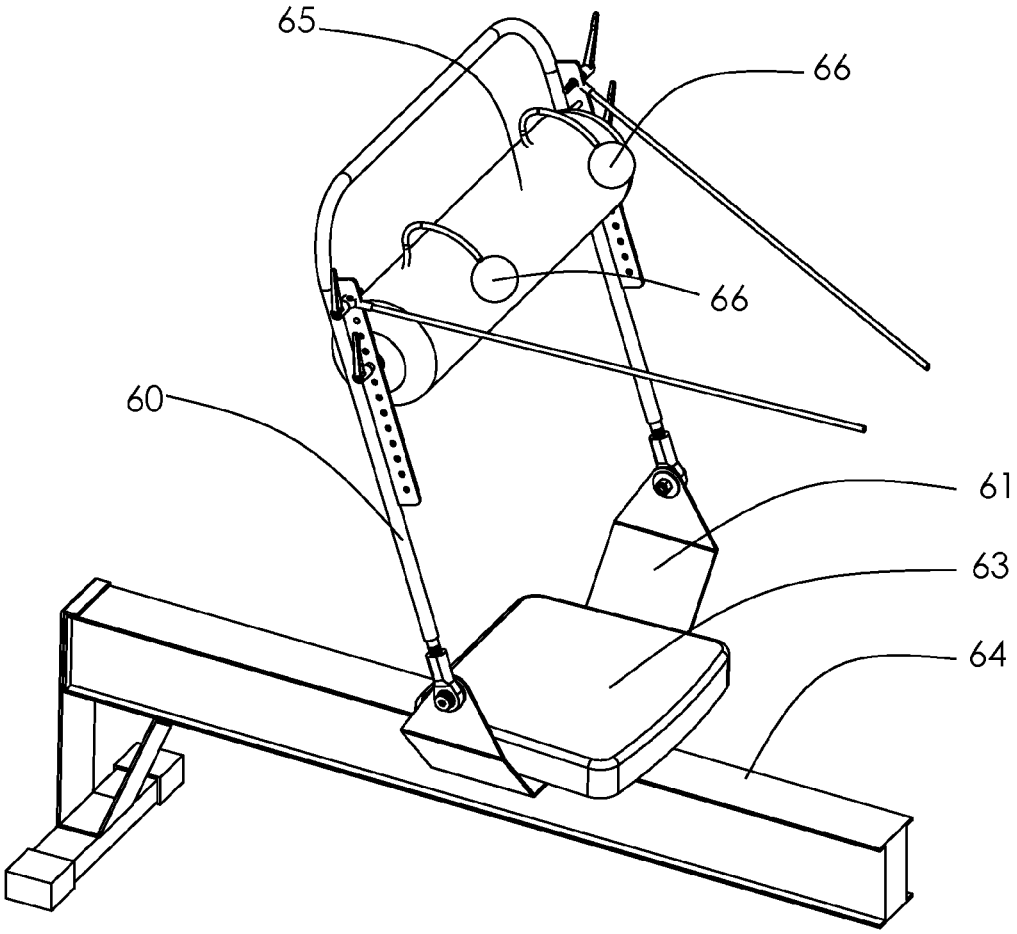
FIG. 6 provides a perspective view of the device of the present invention, attached to a seat which slides along a rail of an exercise machine.

FIG. 6 provides a perspective view of the device of the invention, as attached to a seat and a support or rail. As noted above, the seat and rail are similar to what is provided in a conventional exercise machine. The figure shows the frame 60, and the base 61 which fits between the seat 63 and the support or rail 64. Contact pad 65 is mounted on the frame, and grips 66 are connected to the pad.

Figure 7:
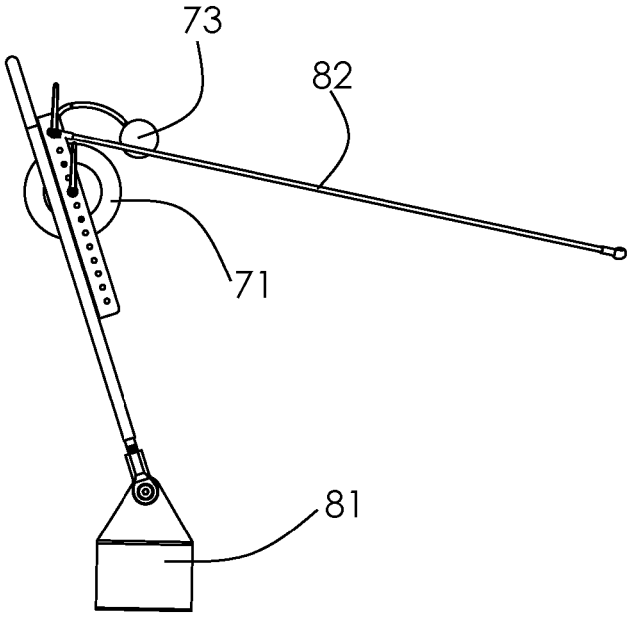
FIG. 7 provides an end view of the device of the present invention.

FIGS. 7 and 8 provide an end view and a perspective view, respectively, of the device of the present invention. The perspective view of FIG. 8 especially provides a view of the device of the present invention, in isolation from surrounding equipment. Thus, for example, FIG. 8 illustrates the entire base 81, which will fit between the seat and a rail or other support. The cables 82 may be considered part of the device of the present invention, but, as explained above, these cables are intended to be attached to another cable that is provided with a prior art rowing or exercise machine. The figures also illustrate contact pad 71 and grips 73.

FIG. 9 provides a perspective view of the device of the present invention in isolation, and without the grips or cables. Perforated strips 91 enable the contact pad 93 to be moved upward or downward, along frame 95. A fastener 94 facilitates connection of a cable (not shown in FIG. 9) to the frame. The strips 91 also provide means for adjusting the point of connection of the cables (such as cables 19 of FIG. 1) to the frame. Screw holes 97 allow attachment of the base 96 to a support of an exercise machine.

As explained above, vertical adjustment of the position of the cable connection varies the difficulty of the exercise. The athlete can gradually adjust the position of the cable connection as he or she becomes more adept at using the device properly. The position of the contact pad is also adjustable, enabling the device to accommodate athletes of varying heights.

An important feature of the device of the present invention is its independence of specific hardware. The device can be used with a wide variety of rowing machines, or other exercise machines, of the prior art. The device requires only the presence of a slidable seat, a foot rest, and a tensioning means, such as an elastic cable. The specific rowing machine illustrated in the figures is only exemplary, and can be replaced with some other device. The device of the present invention therefore can be used to convert a rowing machine, or other exercise machine, of the prior art, into a machine which trains the athlete to perform an exercise cycle without the use of arms, and thus to learn to use various muscle groups in the desired order.

The present invention is not limited to use with rowing machines. The invention can be used with a variety of exercise machines which require an athlete to perform reciprocating movements, including but not necessarily limited to, the weight-lifting exercise machine in the above-cited U.S. patent application, in which the athlete pulls a cable which causes a weight to be lifted.

The invention can be modified in other ways. The specific means of attachment of the cable to the perforated strip can be varied. The shape of the grips attached to the contact pad can be changed. The structure of the contact pad itself can be modified. As noted above, the grips could be fastened to either the contact pad or directly to the frame; what is important is that the user is able to pull the frame forward on the recovery segment of the exercise. These and other modifications, which will be apparent to the reader skilled in the art, should be considered within the spirit and scope of the following claims.

What is claimed is:

1. An exercise device, comprising:

a frame including a pair of substantially parallel bars having first and second ends, the first ends of the parallel bars being connected by a cross bar, the second ends of the parallel bars being pivotably connected to a base, the base extending continuously from one of the parallel bars to the other, the device including adjustment strips attached to said parallel bars, and a substantially cylindrical contact pad attached to the adjustment strips, such that the contact pad extends substantially from one of the parallel bars to the other, further comprising a cable connected to the frame, wherein there are two cables, connected respectively at selectable locations along the adjustment strips, the cables being joined together for connection to an external machine.

2. The exercise device of claim 1, wherein the adjustment strip includes a plurality of perforations.

3. The exercise device of claim 1, further comprising a pair of grips attached to the contact pad.

4. The exercise device of claim 1, wherein the base comprises an articulated member formed of a plurality of substantially flattened pieces.

5. The exercise device of claim 4, wherein the base includes a central flattened member which has at least one screw hole.

6. An exercise trainer, comprising:

a) an exercise machine attached to a cable, the exercise machine providing resistance to a force exerted on the cable, b) a seat mounted for reciprocating translational motion along a support, c) a pair of foot stretchers mounted to the support, and d) an exercise device, comprising:

a frame including a pair of substantially parallel bars, the parallel bars being pivotably connected to a base, the base extending continuously from one of the parallel bars to the other, the device including adjustment strips attached to said parallel bars, and a substantially cylindrical contact pad attached to the adjustment strips, such that the contact pad extends substantially from one of the parallel bars to the other, the base being positioned between the seat and the support, wherein the cable is attached to at least one of the adjustment strips.

7. The exercise trainer of claim 6, wherein the parallel bars have first and second ends, wherein the first ends of the parallel bars are connected by a cross bar, and wherein the parallel bars are connected to the base at their second ends.

8. The exercise trainer of claim 6, wherein the adjustment strips include a plurality of perforations.

9. The exercise trainer of claim 6, further comprising a pair of grips attached to the contact pad.

10. The exercise trainer of claim 9, wherein the grips are substantially independent of the cable.

11. The exercise trainer of claim 6, wherein the base comprises an articulated member formed of a plurality of substantially flat pieces.

12. A method of exercising through the use of an exercise device having a frame which is mounted for reciprocating translational motion along a support and for pivotable motion about a base which is positioned under a seat which slides along the support, wherein the frame is connected by a cable to an exercise machine, the method comprising the steps of:

a) initiating a drive segment, comprising pushing on a foot stretcher so as to cause the seat to slide backwards along the support against resistance of the cable, b) continuing the drive segment, wherein the seat approaches a maximum translational speed, and wherein the frame begins to pivot backward, c) completing the drive segment, wherein the seat has traveled a maximum distance backward and wherein the frame has pivoted backward through a maximum angle, and d) performing a recovery segment by allowing the cable resiliently to pull the frame towards the exercise machine, wherein the seat moves forward and the frame pivots upwardly so as to return to a condition suitable for repeating the method starting with step (a), wherein the frame includes at least one adjustment strip, and wherein the cable is attached to the adjustment strip, and wherein the method further comprises re-attaching the cable to a different position along the adjustment strip, and repeating steps (a)-(d).

13. The method of claim 12, wherein the frame of the exercise device includes a contact pad, and wherein at least one grip is attached to the contact pad, and wherein the method further comprises grasping the grip while the seat moves back and forth along the support.

14. The method of claim 12, wherein the frame of the exercise device includes a contact pad, and wherein the method includes maintaining contact with the contact pad substantially throughout a performance of steps (a)-(d).

15. The method of claim 14, wherein at least one grip is attached to the contact pad, and wherein the maintaining step comprises holding the grips so as to maintain contact with the contact pad.

16. The method of claim 12, wherein steps (a)-(d) are performed without assistance of arms as a means of propulsion.

* * * * *